United States Patent [19]

Paccoret et al.

[11] Patent Number: 4,964,825

[45] Date of Patent: Oct. 23, 1990

[54] COMPOSITE AQUATIC BOARD AND MANUFACTURING METHOD

[76] Inventors: Claudio S. Paccoret, 2830 Instone Ct., Westlake Village, Calif. 91361; Howard E. Crawford, III, 6450 Webster #395, Ventura, Calif. 93003

[21] Appl. No.: 385,657

[22] Filed: Jul. 27, 1989

[51] Int. Cl.[5] ..... A63C 15/00

[52] U.S. Cl. ..... 441/74; 114/91; 114/93; 114/39.2; 441/79

[58] Field of Search ..... 441/74, 79; 114/39.2, 114/90, 91, 93

[56] References Cited

U.S. PATENT DOCUMENTS

| | | | |
|---|---|---|---|
| 3,514,798 | 6/1970 | Ellis | 441/74 |
| 4,804,347 | 2/1989 | Ross | 441/79 |
| 4,904,215 | 2/1990 | Sherwood | 114/140 |

FOREIGN PATENT DOCUMENTS

| | | | |
|---|---|---|---|
| 2602376 | 7/1977 | Fed. Rep. of Germany | 441/74 |
| 3440553 | 3/1985 | Fed. Rep. of Germany | 441/74 |
| 3409772 | 6/1985 | Fed. Rep. of Germany | 114/39.2 |
| 2336954 | 7/1977 | France | 441/74 |
| 2466260 | 4/1981 | France | 441/74 |
| 8201525 | 5/1982 | World Int. Prop. O. | 441/74 |

OTHER PUBLICATIONS

BIC Sport Advertisement.
Alpha Advertisement.
Ultra Advertisement.
Lancar Advertisement.
J. Mac McClellan, "The Starship Chronicles", *Flying,* Mar. 1989, pp. 56–62.

*Primary Examiner*—Sherman Basinger
*Assistant Examiner*—Thomas J. Brahan
*Attorney, Agent, or Firm*—Koppel & Jacobs

[57] ABSTRACT

An aquatic board construction for sail boards, surf boards and the like has shaped upper and lower sections which are joined together with a generally hollow interior. Each section has a sandwich construction with high strength outer and inner skins, and a core formed from a filler material sandwiched between the two skins. The skins are preferably formed from multiple layers of a thermosetting resin impregnated into a fabric material. The outer skins extend beyond the sandwich construction of each section, with the two sections joined together along the extended portions of their outer skins. Receivers for accessories such as a fin, mast and the like are formed integrally with the board structure. The receivers have transverse flanges which are lodged between the inner and outer skins to retain the receivers in place. Structural webs having a similar sandwich construction to the board sections may be provided through the hollow interior of the board. The completed board is high strength yet light weight.

12 Claims, 4 Drawing Sheets

COMPOSITE AQUATIC BOARD AND MANUFACTURING METHOD

BACKGROUND OF THE INVENTION

1. Field of the Invention

This invention relates to aquatic boards, and more particularly to sail boards in which light weight is desirable.

2. Description of the Related Art

Current sail boards, surf boards and similar aquatic sports devices are constructed with a solid foam or styrene core which is coated with a fiberglass or polyester resin, and occupies all or almost all of the interior space within the board. There are two basic fabrication techniques. With one technique, a shaped core is first formed, and then covered with an outer protective resin skin. With the other technique, a thermoforming process is used to blow a resin into a mold to form the outer skin, which is then injected with a foam core. In both cases the core does not add significantly to the strength of the board, but the finished board is heavier than would otherwise be desired.

In an attempt to eliminate the solid interior core, a hollow board has previously been fabricated through a blow molding process without adding an interior core. However, to obtain the necessary structural strength the walls had to be made so thick that the board was too heavy.

It has also been difficult to design a sail board with a mechanism to securely receive and capture a fin on the underside of the board, or a sail mast on the upper side of the board, in such a way that these items can easily be attached and then removed for storage. Fin boxes and mast tracks of similar design have commonly been used for this purpose. These items consist of a generally box-shaped housing having a grooved slot which receives a fin or mast. After the manufacture of a board has been completed, openings are routed out in the board, and the fin box and mast track inserted into their respective openings. They are either held in place by a pressure fit, or covered with a fiberglass and resin layer into which an opening is routed to expose the fin or mast slot.

With this type of construction, the laminate around the fin box or mast track can crack and break, releasing the device. In an attempt to overcome this problem, the fin box has occasionally been extended up to the upper surface of the board to give it greater stability. However, especially since the fin box is typically made from metal, this can add significantly to the weight of the overall board.

SUMMARY OF THE INVENTION

The present invention employs a new approach to the design of aquatic boards, and a new manufacturing technique, to produce a board that is high in strength yet very light weight. The new board construction also accommodates a novel design for a fin or mast receiver that substantially eliminates the prior breakage and retention problems.

According to the invention, shaped upper and lower sections are joined together to form a board with a generally hollow interior. Each section is formed with a generally sandwich construction including a high strength outer skin, an inner skin spaced from the outer skin, and a core formed from a filler material which is sandwiched between the inner and outer skins. The inner and outer skins are preferably formed from one or more layers of a cured thermosetting resin which has been impregnated into a fabric material.

To join the two sections together, the outer skins of each section preferably extend beyond the sandwich construction to form peripheral webs. These webs are turned inward towards the interior of the board and joined together with an adhesive.

A specially constructed receiver for a board accessory such as a fin, mast or the like is also provided. The receiver is generally T-shaped, having a main body portion with an outward facing receiver slot, and a pair of opposed flanges that extend transverse to the main body portion. The receiver is held in place within the board with its flanges lodged between the inner and outer skins, displacing the core material in the vicinity of the receiver and retaining the receiver in place. An opening is provided in the outer skin to expose the receiver slot. At least one layer of the inner skin may be extended over the rear of the receiver to provide an extra degree of retention. One or more structural webs or bulkheads may also be provided through the interior of the board between its upper and lower sections, to give additional strength.

With the preferred manufacturing technique, each section is initially manufactured separately. One of the skins is placed in a mold to assume the desired shape for the section. The filler material is then placed over the first skin, and the second skin is placed over the filler material. The skins are then cured, by heating and pressurizing in the case of thermosetting resins. A fin box or mast track is added by placing the device over the first skin, before the second skin is added, with its flanges aligned with the adjacent filler material. The second skin is then placed over the filler material and receiver, so that the receiver is firmly retained in place with its flanges between the two skins when the section is cured.

These and other features and advantages of the invention will be apparent to those skilled in the art from the following detailed description of preferred embodiments, taken together with the accompanying drawings, in which:

DETAILED DESCRIPTION OF THE INVENTION

Figure 1:
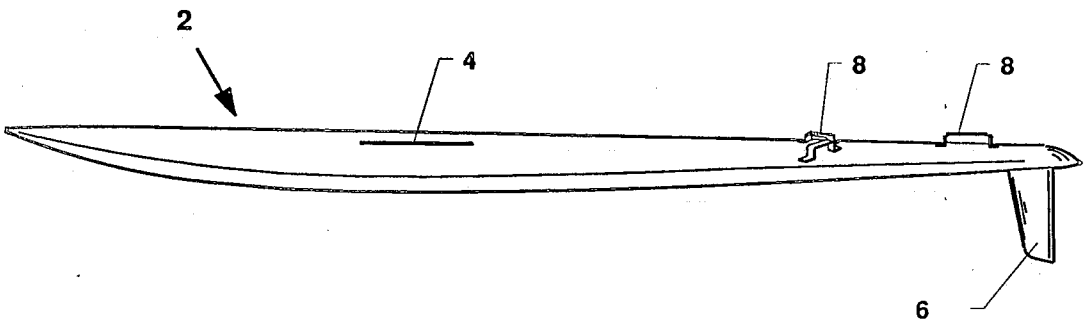
FIG. 1 is a perspective view of a sail board constructed in accordance with the invention.

FIG. 1 is a perspective view of a sail board constructed in accordance with the invention. While preferred embodiments of the invention will be described herein with reference to a sail board, it should be understood that the invention is also applicable to other types of aquatic boards, such as surf boards.

The sail board 2 is similar in outer appearance to prior boards. It includes a slotted mast track 4 on its upper surface, or deck, for receiving a sail mast. A fin 6 is held in place on the underside of the board towards its rear by a fin box (not shown) similar in construction to mast track 4. A number of footholds 8 are provided on the rear portion of the deck for use in high waves, etc.

Figure 2:
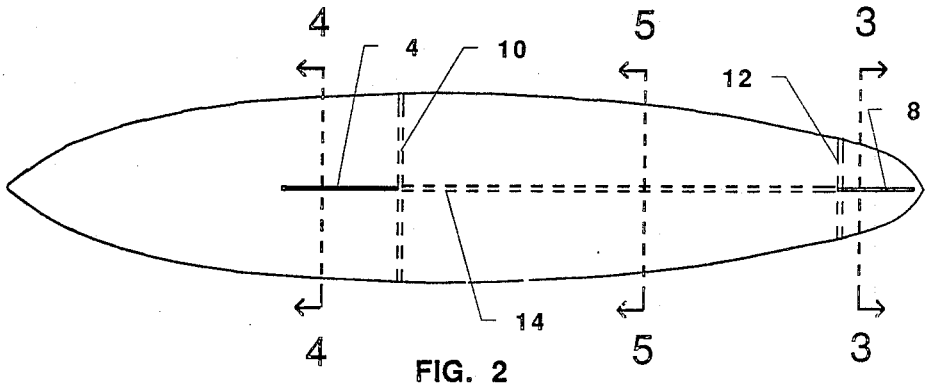
FIG. 2 is an upper plan view of the board.

A general layout showing the orientation of the structural elements of the board is given in FIG. 2. The fin box 8 on the underside of the board is indicated by a dashed line. Interior structural webs or bulkheads within the interior of the board are also indicated by dashed lines. In the embodiment shown, a central transverse bulkhead 10 is provided just to the rear of the mast track 4, another transverse bulkhead 12 is provided immediately forward of fin box 8, and a longitudinal bulkhead 14 runs between the two transverse bulkheads.

Figure 3:
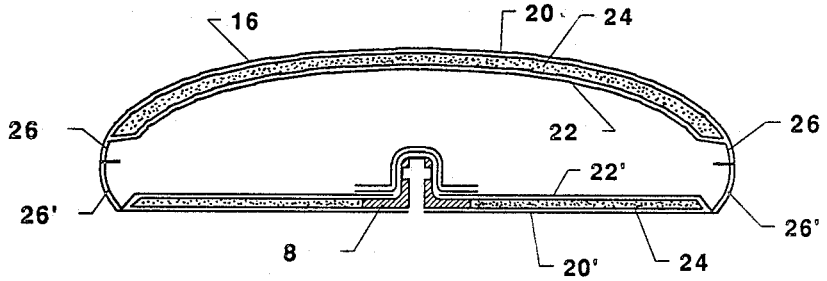
FIGS. 3, 4 and 5 are section views taken along the lines 3—3, 4—4 and 5—5 of FIG. 2, respectively.
Figure 4:
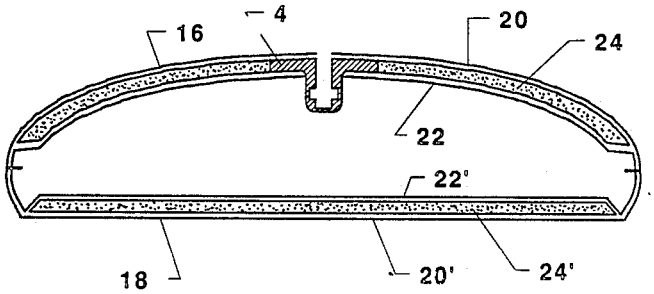
Figure 5:
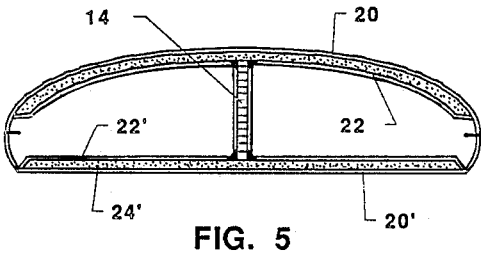
Figure 6:
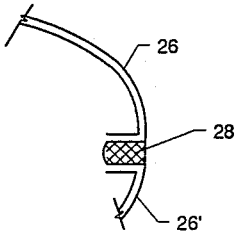
FIG. 6 is an enlarged fragmentary view showing the joint between the upper and lower board sections.

The interior construction of the board is shown in FIGS. 3–5. It can be seen that the board is basically hollow, being formed from an upper section or deck 16 and a lower section 18 which are joined together along their peripheries. The detailed construction of these sections is discussed later. They each consist of an outer skin 20, an inner skin 22 and a filler material 24 sandwiched between the inner and outer skins (a prime is used to indicate these elements for the lower section 18). The outer skins 20, 20′ extend beyond the limits of their respective sandwich constructions, forming peripheral webs 26, 26′. The two webs are joined together by turning them inward into the interior of the board and joining them together with a waterproof structural epoxy adhesive 28, as shown in FIG. 6. A preferred adhesive for this purpose is the RF-912 epoxy provided by Resin Formulators Company.

The thin inner and outer skins are formed from a high strength material, preferably a cured thermosetting resin. Because they are thin, the skins are relatively light in weight. The sandwiched core material is considerably lighter in weight per unit volume than the skins, and adds to the board's resistance to impact. Since the large majority of the board's volume is hollow, the resulting structure is considerably lighter in weight than prior boards, and yet has equal or greater strength.

The joinder of the two sections by means of peripheral webs 26, 26′ adds a desirable degree of flexibility around the edge of the board, while joining the webs along inward-directed bends increases their stiffness and prevents the joint from being too flexible. As a result, the edge of the board has a high resistance to shear stresses but a considerably lower resistance to bending loads, which is a desirable characteristic for high performance boarding.

Figure 7:
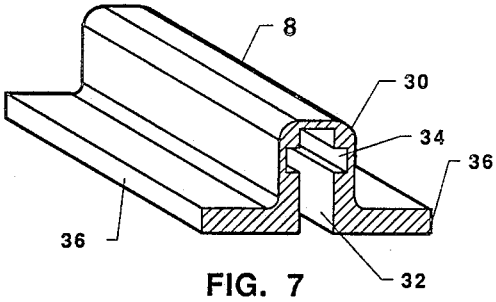
FIG. 7 is a perspective view of a specially constructed fin box or mast track incorporated into the board.

A novel construction for an accessory receiver such as fin box 8, a mast track or the like is shown in FIG. 7. The receiver is constructed from a strong, light weight material such as aluminum. It has an upstanding central body portion or rib 30 into which a receiver slot 32 is formed. Slot 32 extends most of the way into rib 30, and has a transverse groove 34 near its upper end. This is a standard type of construction, and is used to receive a dowel at the end of a mast or fin. A cross-pin on the dowel is turned into the groove 34 to retain the fin or mast in place.

In addition to the standard construction described thus far, the receiver 8 has a pair of flanges 36 which extend transversely from rib 30 at the opening of slot 32. These flanges cooperate with the novel board construction to hold the receiver in place more securely than with previous board designs, and yet with no substantial increase in weight.

Figure 8:
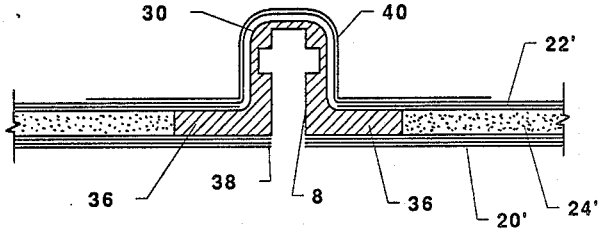
FIG. 8 is a sectional view showing the manner in which the fin box or mast track of FIG. 7 is incorporated into the board.

A cross-section of a portion of the board showing the placement of receiver 8 is provided in FIG. 8. A void is provided in the filler material 24′ to make space for the receiver flanges 36, which are approximately equal in thickness to the filler material. The outer and inner board skins 20′ and 22′ extend over the receiver flanges, holding the receiver securely in place when the skins are cured. An opening 38 is formed in the outer skin when the board has been completed, to expose the receiver slot.

As seen in FIG. 8, the outer and inner skins 20′, 22′ can be formed from multiple layers. In practice, it has been found that different numbers and orientations of layers can be provided at different locations on the board, depending upon the structural requirements at each location. In general, from one to about ten layers of a thermosetting resin may be used. It is important that the amount of resin be carefully controlled, since too much resin will actually weaken the board in addition to making it heavier. To control the resin volume, various types of fabrics that have been pre-impregnated with a fixed amount of resin may be employed. Thermosetting resins are preferred, since they cure relatively quickly and can be obtained in the desired form of pre-impregnated fabrics. However, other types of resins might also be employed, such as resins which cure in the presence of a catalyst.

Three layers of matrix fiber-resin are preferably used to construct the outer skin for both the top and bottom sections, with two layers for the inner skins. Each layer is about 0.25mm thick, yielding skins that are overall quite thin. The core 24′ is preferably about 6.35mm thick.

The preferred resin for both the top and bottom sections is manufactured by Hexcel Corporation under the name F161 Thermoset Epoxy. The resin may be impregnated into various types of fabrics. For the inner layers, either Hexcel Corporation type 3783 glass fabric or Hercules Corporation type 584 carbon fabric may be employed. The glass fabric is generally less expensive and not as stiff as the carbon fabric, but is heavier. The carbon fabric can be used particularly in areas where it is desirable to have a strong resistance to bending, such as the areas adjacent to the fin box and mast track. For the outer layers, an aramid fiber such as DuPont Corporation type K49-900 Kevlar fabric is preferred. This fabric has a high resistance to shear and tension forces, but not to compression.

Various types of filler materials are also available. In the preferred embodiment, the top section employs Hexcel Corporation type HRH 10/F50-4.5 Honeycomb Nomex, which is a honeycomb aramid paper that is lightweight, strong and resilient to impact. For the bottom section, Diab Barracuda type HT-70 polyvinyl foam is preferred. This is a closed cell foam that has a very low rate of water absorption in case the board is punctured.

With some resins, such as the F161 Thermoset Epoxy mentioned above, successive layers need to be adhered to each other. The American Cyanamid type FM61 modified epoxy film is a preferred adhesive for this purpose.

After the construction of the board has been completed, an outer coating of clear resin is desirable to seal the board, add impact resistance, and resist ultraviolet rays to help preserve underlying design work. The type L9035 epoxy by Epic Resin Company has been found suitable for this purpose.

To give additional strength to the receiver, one or more layers of the inner skin may be lapped over the receiver rib 30 on the inside of the board. This in indicated by inner layer 40 in FIG. 8.

The upper and lower board sections are manufactured separately, and then joined together as described. To manufacture each section, the layers forming one of the skins are first placed in a mold having the desired shape for the board. The core is then placed over the first skin layer. The core will include an opening for either a fin box or mast track, which is put in place with its flanges level with the core. The layers of the second skin are next placed over the core and receiver, with a slot cut in the skin to accommodate the receiver's rib. One or more additional skin layers may then be placed over the rib for extra strength. Finally, the section is cured at a suitable temperature and pressure for the materials used. With the particular thermosetting resin mentioned above, curing takes place at a temperature of 250° F. and a pressure of 48psi for a total cure cycle of about 2½ hours (½ hour to heat, 1½ hours to cure, ½ hour to cool).

Figure 9:
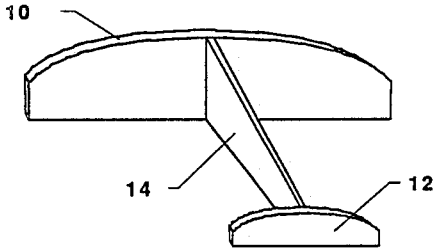
FIG. 9 is a perspective view of structural webs provided in the interior of the board.
Figure 10:
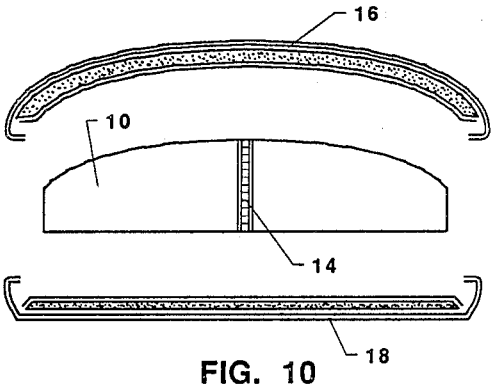
FIG. 10 is an exploded sectional view showing a central portion of the board.

FIGS. 9 and 10 show the structural webs (bulkheads) that extend between the upper and lower board sections to provide additional strength with little additional weight. The placement of longitudinal and transverse bulkheads can be customized for particular board sizes and reinforcement requirements. This is a distinct advantage of the present invention that is not applicable to prior boards, in which the interior is filled with a foam core. The longitudinal web 14 bears compression and shear loads generated at the top and bottom sections, and is responsible for the longitudinal stiffness of the board. The transverse webs 10 and 12 also bear compression and shear loads generated at the top and/or bottom sections, and are responsible for much of the torsional stiffness of the board. The structural webs are formed with a sandwich construction similar to that of the upper and lower board sections, and are attached to the board sections by high strength adhesives.

The resulting board is considerably lighter than prior boards of comparable structural integrity, and is less subject to damage or loss relating to the fin box and mast track. While particular embodiments of the board have been shown and described, it should be understood that numerous variations and alternate embodiments will occur to those skilled in the art. Accordingly, it is intended that the invention be limited only in terms of the appended claims.

We claim:

1. An aquatic board comprising:

shaped upper and lower sections joined together to form a board with a generally hollow interior, each section having a generally sandwich construction with a high strength outer skin, an inner skin spaced inwardly from the outer skin, and a core formed from a filler material sandwiched between the inner and outer skins, and a receiver for a board accessory such as a fin or a mast in at least one of said sections, said receiver comprising a main body portion having an outward facing receiver slot and extending inwardly into the generally hollow interior of the board, and a pair of opposed flanges extending transverse to the main body portion and lodged between the inner and outer skins, said flanges retaining the receiver in place between said inner and outer skins, said inner skin formed from a high strength material, and said outer skin having an opening aligned with said receiver slot.

2. The aquatic board of claim 1, said receiver flanges being approximately equal in thickness to the core.

3. The aquatic board of claim 1, the inner and outer skins of the board section carrying said receiver comprising cured resins.

4. The aquatic board of claim 3, the inner skin of the board section carrying said receiver comprising multiple layers of a cured resin, with at least one of said layers extending over the inward extending portion of said receiver.

5. The aquatic board of claim 3, said resins comprising thermosetting resins.

6. An aquatic board structure for receiving a board accessory such as a fin or a mast, comprising:

a board section having a generally sandwich construction with a high strength outer skin, a high strength inner skin spaced from the outer skin, and a core formed from a filler material sandwiched between the inner and outer skins, and a receiver for the board accessory, said receiver comprising a main body portion having a receiver slot facing the outer skin and extending in the opposite direction beyond the inner skin, and a pair of opposed flanges extending transverse to the main body portion and lodged between the inner and outer skins, said flanges retaining said receiver in place between said inner and outer skins, said outer skin having an opening aligned with said receiver slot.

7. The aquatic board structure of claim 6, said receiver flanges being approximately equal in thickness to the core.

8. The aquatic board structure of claim 6, said inner and outer skins comprising cured matrix fiber-resin.

9. The aquatic board of claim 8, said skins comprising multiple layers of a matrix fiber-resin, with at least one layer of the inner skin extending over said receiver.

10. The aquatic board of claim 8, wherein the resin of each skin is impregnated into a fabric material.

11. The aquatic board of claim 8, said resin comprising thermosetting resins.

12. The aquatic board of claim 8, said core comprising a foam or honeycomb material.

* * * * *